United States Patent [19]

Okumura

[11] Patent Number: 4,787,286

[45] Date of Patent: Nov. 29, 1988

[54] SNARE MECHANISM FOR A DRUM

[75] Inventor: Yukimasa Okumura, Hamamatsu, Japan

[73] Assignee: Nippon Gakki Seizo Kabushiki Kaisha, Japan

[21] Appl. No.: 84,618

[22] Filed: Aug. 12, 1987

[30] Foreign Application Priority Data

Aug. 13, 1986 [JP] Japan ..... 61-123369[U]
Aug. 13, 1986 [JP] Japan ..... 61-123370[U]

[51] Int. Cl.[4] ..... G10D 13/02
[52] U.S. Cl. ..... 84/417
[58] Field of Search ..... 84/415–417, 84/411 A

[56] References Cited

U.S. PATENT DOCUMENTS 389,594 9/1888 Plowe ..... 84/417
2,495,896 1/1950 Jeffries ..... 84/417

FOREIGN PATENT DOCUMENTS 1106854 3/1968 United Kingdom ..... 84/417

*Primary Examiner*—L. T. Hix
*Assistant Examiner*—Brian W. Brown
*Attorney, Agent, or Firm*—Ostrolenk, Faber, Gerb & Soffen

[57] ABSTRACT

In construction of a drum having a cylindrical stem and fore side and rear side drum heads attached to both open ends of the stem, a snappy is arranged within said stem facing the inner surface of the fore side drum head with an adjustable clearance and at adjustable tension for easy generation of musical tones of rich rising characteristics and rich tone volume over the entire tone range.

8 Claims, 2 Drawing Sheets

SNARE MECHANISM FOR A DRUM

BACKGROUND OF THE INVENTION

The present invention relates to an improved snare mechanism for a drum and more particularly relates to an improvement in arrangement of a snare mechanism on a drum which exhibits special acoustic effect by selective contact of a snappy with a drum head.

A snare mechanism for a drum is usually provided facing a rear side drum head, with a snappy made of several fine metallic wires. When the snappy is placed in contact with the rear side drum head, vibration of the rear side drum head is transmitted to the snappy to cause special acoustic effects in which musical tones of lilting tone colours are generated. When the snappy is moved out of contact with the rear side drum head, thick musical tones are generated. Thus, by moving the snappy into and out of contact with the rear side drum head enables generation of musical tones of different tone colours.

In the case of the conventional snare mechanism, however, movement of the snappy into and out of contact with the drum head is caused by vertical movement of snappy plates or by pulling the snappy plates. Such a mechanism allows a very narrow range of adjustment in height and tension of the snappy and, as a consequence, cannot provide satisfactory effects.

When the front side drum head is beaten, vibration caused thereby is transmitted to the rear side drum head via the air column in the stem of the drum, and a corresponding vibration of the rear side drum head drives the snappy for vibration. Such a generating mechanism of vibration results in poor rising characteristics of the tones to be ultimately generated.

During transmission of vibration from the front side to the rear side drum head, tones of high frequencies tend to experience early decay due to viscous resistance of the air column in the stem of the drum. Because of such early decay it is difficult to obtain tones of rich tone volume over the entire tone range.

When the snappy is pressed against the drum head, the driving force must act against a component of force caused by tension of the drum head. There is a linear relationship between the distance of movement of the snappy and the load from the drum head (the above-described component of force). However, this linear relationship is lost near the maximum moving distance of the snappy.

To lift the snappy, a link mechanism is conventionally employed. This link mechanism takes the form of a crank which includes an upper lever coupled at its top end to the snappy and a lower lever coupled at its lower end to a driving source, and the two levers are pin-jointed at their mating ends. When the angular speed $\omega$ of the levers is assumed to be constant, the relationship between the rotation angle $\theta$ of the lower lever and the driving force F given by the link mechanism is defined by the following equation.

$$F=m\gamma(\cos\theta+\gamma/l\cos 2\theta)\omega^2$$

Wherein m indicates the equivalent weight of the link mechanism.

It will be well understood that the rotation angle $\theta$ varies in the range from 0 to 45 degrees. When the angle $\theta$ is equal to 45 degrees, the direction of the upper lever is normal to that of the lower lever and, under this condition, the lifting stroke is at its lower end. When the angle $\theta$ is equal to 0 degree, the direction of the upper lever coincides with that of the lower lever and, under this condition, the lifting stroke is at its top end. As is clear from the above-described equation, the value of the driving force F created by the lifting mechanism decreases as the angle $\theta$ approaches 0 degree, in other words, as the lifting stroke approaches its top end. Thus, the snappy cannot contact the drum head with a constant driving force over the entire range of the lifting stroke of the lifting mechanism. In addition, the dynamic characteristics of the lifting mechanism is rigidly defined by its construction, thereby disenabling free output of the driving force.

SUMMARY OF THE INVENTION

It is one object of the present invention to provide a snare mechanism which assures generation of tones of rich rising characteristics and rich tone volume over the entire tone range.

It is another object of the present invention to provide a snare mechanism which assures uniform and free snappy driving force over the entire lifting stroke.

In accordance with the basic aspect of the present invention, a snappy is arranged within the stem of a drum facing the inner surface of the fore side drum head with an adjustable clearance and selectively placed in and out of contact with the drum head at adjustable tension.

DESCRIPTION OF THE PREFERRED EMBODIMENTS

Figure 1:
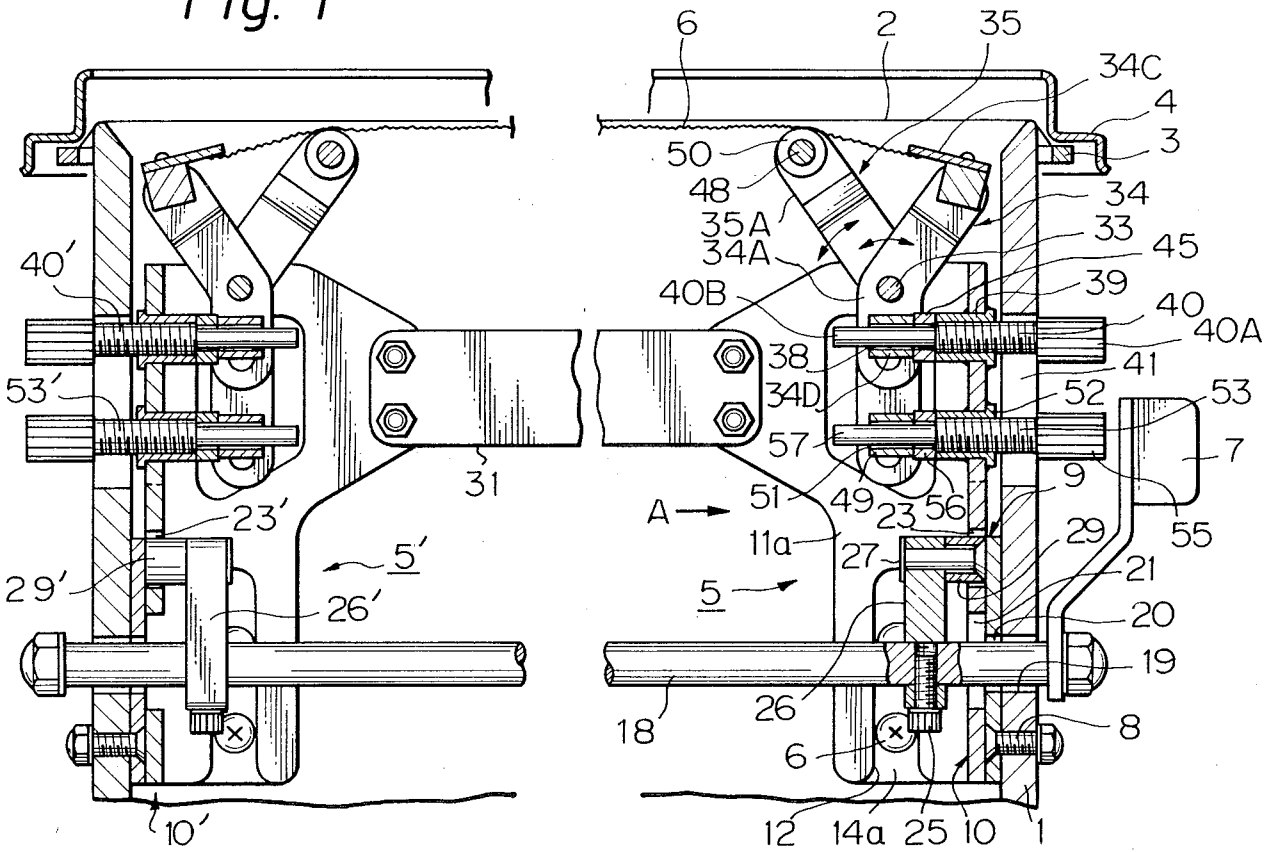
FIG. 1 is a side view, partly in section, of a drum provided with one embodiment of the snare mechanism in accordance with the present invention.

In FIG. 1, a drum has a cylindrical stem 1 open at both ends and the upper open end thereof is covered with a fore side drum head 2. Near the top open end is a head ring 3 circumferentially mounted to the stem 1 and pressed downwards by a fastener ring 4 to apply a prescribed tension to the drum head 2. The fastener ring 4 is coupled to a lug (not shown) via fastener bolts attached to the outer periphery of the stem 1 and displaced vertically by turning adjustment of the fastener bolts so that corresponding change in pressure should adjust the tension on the fore side drum head 2.

Needless to say, the lower end of the stem 1 is similarly covered with a rear side drum head (not shown).

Within the stem 1, a pair of snare mechanisms 5 and 5' are mounted to the inner wall near the top opening at opposite diametric positions. Except for the provision of a shift lever 7, the right side snare mechanism 5 is similar in construction and operation to the left side snare mechanism 5'. For this reason, the following description is mainly directed to the right side snare mechanism 5.

Figure 2:
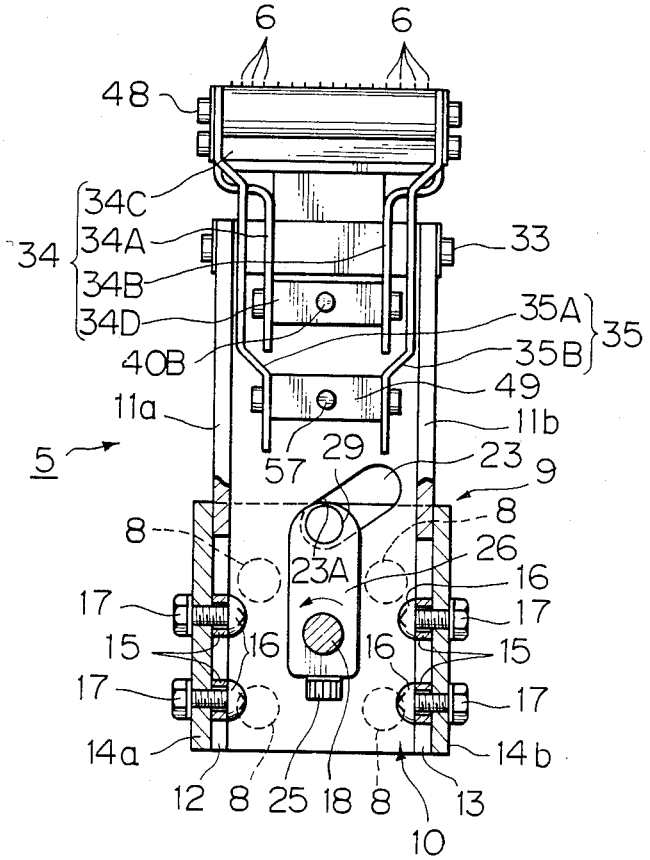
FIG. 2 is an end view seen in the direction of an arrow A in FIG. 1.

The snare mechanism 5 includes a plurality of bases 9 (FIGS. 1 and 2) each secured to the inner wall of the stem 1, for example, by set screw 8. Each base 9 has an end wall and a pair of side walls opening towards the center of the stem 1. A snappy base 10 is inserted into each base 9 at its lower end section in a vertically slidable fashion. The snappy base 10 also has an end wall and a pair of side walls 11*a* and 11*b* while opening towards the center of the stem 1. Vertical slots 12 and 13 are formed in the side walls 11*a* and 11*b* facing each other. Collars 15 mounted to the side walls 14*a* and 14*b* of the base 9 are inserted into the slots 12 and 13 as best seen in FIG. 2. Collars 15 are threaded over screws 16 which are screwed into the side walls 14*a* and 14*b* and accompanied with nuts 17 so that the snappy base 10 is slidable vertically and is guided by the collars 15.

The shift lever 7 is used for driving the snappy base 10 for vertical displacement for selective contact of a snappy 6 with the inner surface of the fore side drum head 2. The shift lever 7 is coupled to the right end of a center rod 18 which extends horizontally and diametrically through the stem 1. Through holes 19 are formed in the stem 1 for idle passage of the center rod 18. Similar through holes 20 and 21 are formed in the base 9 and the snappy base 10. As seen in FIG. 2, the through hole 21 takes the form of a vertical slot which merges at its top end into a slant cam slot 23 in order to allow the vertical displacement of the snappy base 10. Near the junction of the through hole 21, the cam slot 23 is provided with a locker recess 23A.

A radial arm 26 is secured to the center rod 18 via a set screw 25 and its distal end carries a horizontal pin 27. A cam follower 27 is rotatably mounted to the pin 27 in engagement with the cam slot 23 in the snappy base 10.

The cam follow 29, the radial arm 26 and the cam slot 23 form a unit for converting the rotary movement of the center rod 18 to a corresponding linear movement of the snappy base 10.

When the center rod 18 is rotated counterclockwise in FIG. 2 via the shift lever 7, the radial arm 26 turns in the same direction and the cam follower 29 pushes down the snappy base 10 via engagement with the cam slot 23. When the shift lever 7 is returned to the original position, the center rod 18 again turns in the same direction and the cam follower 29 pushes up the snappy base 10 via engagement with the cam slot 23 so that the latter should resume the original position. At this moment, the cam follower 29 partly engages with the locker recess 23A so that the snappy base 10 is maintained at the position for contact of the snappy 6 with the fore side drum head 2.

Concurrently on the side of the snare mechanism 5', a cam follower 29' mounted to the center rod 18 via a radial arm 26' engages a cam slot 23' formed in a snappy base 10'. Since the snappy bases 10 and 10' are connected to each other by a connector plate 31, they are driven for concurrent and similar movement by turning of the shift lever 7.

A support shaft 33 is mounted between the top ends of the side walls 11*a* and 11*b* and a curved snappy locker arm 34 and a curved snappy supporter arm 35 are both rotatably mounted to support shaft 33 at their apexes.

The snappy locker arm 34 (FIG. 2) includes a pair of plates 34A and 34B spaced apart from each other in a direction normal to the center rod 18, a snappy plate 34C connecting the top ends of the plates 34A and 34B and an adjuster rod 34D in the form of a square rod. One end of the snappy 6 is connected to the snappy plate 34C. The adjuster rod 34D is rotatably mounted to the plates 34A and 34B and a bolt hole 38 is formed through the center thereof extending in a direction normal to the center rod 18. Near the bolt hole 38 is a cylindrical nut 39 mounted to the snappy base 10 and a tension adjuster bolt 40 is screwed into the nut 39. To permit passage of the adjuster bolt 40, a vertical slot 41 is formed in the stem 1. The outer end of the adjuster bolt 40 is provided with a knob 40A and the inner end is provided with a small diameter section 40B which is inserted into the bolt hole 38 via a spacer 45.

The snappy supporter arm 35 includes a pair of plates 35A and 35B spaced from each other in a direction normal to the center rod 18, a connector shaft 48 for connecting the top ends of the plates 35A and 35B, an adjuster shaft 49 for connecting the lower ends of the plates 35A and 35B, and a connector tube 50 rotatably inserted over the connector shaft 48. The top face of the connector tube 50 supports the snappy 6 near one end thereof. The adjuster shaft 49 is rotatably mounted to the plates 35A and 35B and a bolt hole 51 is formed through the center thereof extending in a direction normal to the center rod 18, a nut 52 is mounted to the snappy base 10 near the bolt hole 51 and a height adjuster bolt 53 is screwed into the nut 52 passing through the slot 41. The outer end of the adjuster bolt 53 is provided with a knob 55 and the inner end is provided with a small diameter section 57 which is inserted into the bolt hole 51 via a spacer 56. The snappy support arm 35 is longer than the snappy locker arm 34 with its lower end projecting downwards beyond the lower end of the snappy locker arm 34.

The snappy 6 is made up of lots of coiled metallic wires of, for example, 0.8 mm diameter. In one example, it includes 16 metallic wires. Preferably, steel wires are used.

The snare mechanism 5 operates as follows. Under the condition shown in FIG. 1, the snappy locker arm 34 is urged to move in the counterclockwise direction due to tension on the snappy 6 and, as a consequence, the adjuster shaft 34D is kept in pressure contact with the spacer 45. The snappy supporter arm 35 is also urged to move in the counterclockwise direction due to pressure applied by the snappy 6 and, as a consequence, the adjuster shaft 49 is kept in pressure contact with the spacer 56.

When the knob 40A is rotated to insert or extract the tension adjuster bolt 40 under this condition, the snappy locker arm 34 turns clockwise or counterclockwise about the support shaft 33 for adjustment of the tension on the snappy 6. Clockwise rotation causes an increase in tension and counterclockwise rotation causes a decrease in tension. In a similar way, when the knob 55 is turned to insert or extract the height adjuster bolt 53, the snappy supporter arm 35 rotates clockwise or counterclockwise about the support shaft 33 to adjust the height of the connector tube 50. A change in height of the connector tube 50 causes a corresponding change in height of the snappy 6, thereby adjusting the contact pressure of the snappy with the fore side drum head 2.

To adjust both the tension and height, the tension adjuster bolts 40, 40' and the height adjuster bolts 53, 53' of the right and left sides snare mechanisms 5 and 5' are rotated together.

When the center rod 18 is rotated counterclockwise in FIG. 2 via the shift lever 7, the engagement between the cam followers 29, 29' and the cam slots 23, 23' causes concurrent lowering of the snappy bases 10 and 10' so that the snappy 6 is placed out of contact with the inner surface of the fore side drum head 2.

In accordance with the present invention, the snappy 6 is arranged for selective contact with the inner surface of the fore side drum head 2 so that vibration of the snappy 6 will start on beating of the fore side drum head 2. Thus, when compared with the conventional arrangement of the snappy facing the rear side drum head, the rising characteristics of the tones generated are greatly enriched. In addition, since there is no substantial transmission loss of vibration due to viscous resistance of the air column in the stem 1 right after beating of the head, rich tone volume can be obtained over entire tone range.

In accordance with the present invention, the snappy locker and supporter arms 34 and 35 can be easily rotated only by simply inserting or extracting the adjuster bolts 40 and 53, thereby assuring easy and smooth handling of the snare mechanism. By properly increasing the length of the snappy locker and/or supporter arms 34 and 35, the tension on the snappy and/or the height of the snappy, i.e. contact pressure with the drum head, can be adjusted over a wide range. Increased length of these arms causes no trouble in performance since they are both arranged within the stem of the drum.

In accordance with the present invention, the rotary movement of the center rod 18 is converted to the linear movement of the snappy base 10 by means of a cam mechanism. Use of such a cam mechanism for conversion of movement provides driving characteristics which correspond well to the load characteristics from the drum head, thereby assuring uniform and free snappy driving force over the entire lifting stroke.

I claim:

1. An improved snare mechanism for a drum, comprising:

(A) a snappy base for arrangement within the stem of said drum;

(B) a snappy mounted to said snappy base facing the inner surface of the fore side drum head with a clearance;

(C) means for driving said snappy selectively into and out of contact with said inner surface of said fore side drum head; and (D) clearance adjusting means for adjusting said clearance, said clearance adjusting means including:

(1) a snappy supporter arm swingably mounted to a support shaft within said stem and supporting said snappy at a first end thereof;

(2) a height adjuster bolt having an inner end operably coupled to a second end of said snappy supporter arm and an outer end exposed outside said stem for manual operation; and (3) means for converting rotational movement of said height adjuster bolt to swinging movement of said snappy supporter arm.

2. An improved snare mechanism as claimed in claim 1 further comprising means for adjusting the tension of said snappy, said tension adjusting means including a snappy locker arm swingably mounted to a support shaft within said stem and holding one end of said snappy at a first end thereof, a tension adjuster bolt having an inner end operably coupled to a second end of said snappy locker arm and an outer end exposed outside said stem for manual operation, and means for converting a turning movement of said tension adjuster bolt to a swinging movement of said snappy locker arm.

3. An improved snare mechanism as claimed in claim 2 in which:

said converting means includes a nut secured to said snappy base in screw engagement with said tension adjuster bolt and extending normal to said support shaft for said snappy locker arm.

4. An improved snare mechanism as claimed in claim 1 in which:

said converting means includes a nut secured to said snappy base and being in screw engagement with said height adjuster bolt and extending normal to said support shaft for said snappy supporter arm.

5. An improved snare mechanism as claimed in claim 1 in which:

said driving means includes a center rod rotatably mounted to said stem and having an outer end exposed outside said stem for manual operation and means for converting rotational movement of said center rod to linear movement of said snappy base towards and away from said fore side drum head.

6. An improved snare mechanism as claimed in claim 5 in which:

said snappy base has a cam slot; and said converting means includes a cam follower supported by said center rod in engagement with said cam slot in said snappy base.

7. An improved snare mechanism for a drum, comprising:

(a) a snappy base for arrangement within the stem of said drum;

(b) a snappy mounted to said snappy base facing the inner surface of a fore side drum head of said drum with a clearance;

(c) driving means for driving said snappy selectively into an out of contact with said inner surface of said fore side drum head, said driving means including a center rod rotatably mounted to said stem and having an outer end exposed outside said stem for manual operation and converter means for converting rotational movement of said center rod to linear movement of said snappy base towards and away from said fore side drum head.

8. An improved snare mechanism as claimed in claim 7 in which:

said snappy base has a cam slot;

said converter means includes a cam followers supported by said center rod in engagement with said cam slot and said snappy base.

* * * * *